US007963079B2

(12) United States Patent
Schulte

(10) Patent No.: US 7,963,079 B2
(45) Date of Patent: Jun. 21, 2011

(54) STANDARDIZED COMPRESSION BAR SYSTEM FOR A BRACED FRONT CONSTRUCTION

(75) Inventor: Dirk Schulte, Bad Driburg (DE)

(73) Assignee: Dorma GmbH + Co. KG, Ennepetal (DE)

( * ) Notice: Subject to any disclaimer, the term of this patent is extended or adjusted under 35 U.S.C. 154(b) by 783 days.

(21) Appl. No.: 11/988,494

(22) PCT Filed: May 19, 2006

(86) PCT No.: PCT/EP2006/004752

§ 371 (c)(1),
(2), (4) Date: Jan. 8, 2008

(87) PCT Pub. No.: WO2007/006363

PCT Pub. Date: Jan. 18, 2007

(65) Prior Publication Data

US 2009/0255207 A1 Oct. 15, 2009

(30) Foreign Application Priority Data

Jul. 9, 2005 (DE) ..... 10 2005 032 169

(51) Int. Cl.
*E04H 1/00* (2006.01)

(52) U.S. Cl. ..... 52/235; 52/427

(58) Field of Classification Search ..... 52/427, 52/235, 706, 711; 403/367, 368
See application file for complete search history.

(56) References Cited

U.S. PATENT DOCUMENTS

| | | | | |
|---|---|---|---|---|
| 5,787,662 | A | 8/1998 | Danz | |
| 6,412,242 | B1 * | 7/2002 | Elmer | 52/235 |
| 6,467,227 | B2 * | 10/2002 | Elmer | 52/235 |
| 2005/0126090 | A1 | 6/2005 | Lundgren | |

FOREIGN PATENT DOCUMENTS

| | | |
|---|---|---|
| EP | 1 020 574 | 7/2000 |
| EP | 1 291 473 | 3/2003 |
| JP | 7062777 | 3/1995 |
| JP | 2005054508 | 3/2005 |

* cited by examiner

*Primary Examiner* — Basil Katcheves
(74) *Attorney, Agent, or Firm* — Cohen Pontani Lieberman & Pavane LLP

(57) ABSTRACT

A compression bar system for a braced façade structure is disclosed. The system includes a compression bar, and connecting elements connectable to the compression bar. Each connecting element is formed as a pre-fabricated part and is connectable to tie elements.

16 Claims, 6 Drawing Sheets

STANDARDIZED COMPRESSION BAR SYSTEM FOR A BRACED FRONT CONSTRUCTION

CROSS REFERENCE TO RELATED APPLICATIONS

This is a U.S. national stage of International Application No. PCT/EP2006/004752, filed on 19 May 2006. Priority is claimed on German Application No. 10 2005 032 169.0, filed on 9 Jul. 2005.

BACKGROUND OF THE INVENTION

1. Field of the Invention

The invention relates to a compression bar system for a braced façade structure, the compression bar system having a compression bar as well as connecting elements, disposed at the compression bar, for tie members and the like.

2. Description of the Related Art

A braced façade structure or also a rear-braced façade structure is composed of the following structural parts: compression bar system, tie member (cable) and corresponding structural connections such as connecting brackets, dowels, etc. These structural parts represent a static system, which decomposes all external forces, such as wind, acting on the façade, into the individual components tension and compression, and then introduces these safely into the building. The structural elements tie member and compression bar system, which are suitably interconnected such as to create a self-supporting façade lining, are used for the relevant assignment or reception of the individual components tension and compression. The compression bar system is composed of a compression bar and further connecting elements for connecting tie members and further holding elements, e.g. for connecting them to the building. In the conventional application of these compression bar systems, a monolithic structural part is manufactured customized for the project or structure, wherein the different connecting elements for the tie members, and the additional holding elements are directly mounted, e.g. welded, to the bar which is individually cut to length. However, this execution is uneconomical and inflexible, because each time a unique part needs to be produced for the respective individual application, at high manufacturing expense and with the requirement to precisely respect predetermined dimensions.

SUMMARY OF THE INVENTION

Therefore, an object of the present invention is to eliminate the above mentioned disadvantages and to provide a compression bar system which can be manufactured at less expense.

This object is achieved by an embodiment of a compression bar system of the present invention.

According to the invention, the compression bar system is used for a braced façade structure, the compression bar system having a compression bar, as well as connecting elements, disposed at the compression bar, for tie members and the like, and each connecting element is formed as a prefabricated individual part, which is connectable to the compression bar.

On account of the inventive configuration, the connecting elements can be pre-fabricated in large batches. This reduces the cost per unit for the connecting elements. On site, these connecting elements just need to be connected to the compression bars. This simplifies the mounting expense. The compression bars can be delivered by the meter and cut to the required length directly on the construction site. This reduces the logistic expense as well.

The connection of compression bar and connecting element is particularly simple if, according to an advantageous configuration, this is realized with a releasable connection. Such a connection can be produced with simple means on the construction site.

According to a preferred configuration, respectively one connecting element can be fastened at the front and at the rear end of the compression bar. This covers the majority of all application cases, because generally the tie members need to be connected to both ends of the compression bar, respectively.

In order to be able to reliably attach the compression bar at the building, according to a preferred configuration, the connecting element to be fastened at the front end has an attaching element for attachment at the building.

Advantageously, the connecting element to be fastened at the rear end can be covered by a cover cap, in order to achieve a homogeneous façade from the visual point of view as well.

The connection of compression bar and connecting element is particularly simple if, according to an advantageous further development, the compression bar and the connecting elements are screwable to each other via a connecting rod passing through the compression bar and through the connecting elements. Such a connection is not only simple and easy to make, but it also guarantees an overall maintenance-friendly structure.

In order to be able to fasten another plane of tie members in a plane located between the ends of the compression bar, according to a preferred configuration, an additional connecting element can be inserted into the compression bar between the connecting elements, which can be fastened at both ends of the compression bar.

Fastening the tie members at the connecting element is particularly simple if, according to a preferred configuration, each connecting element is provided with connecting lugs for the tie members.

In order to be able to realize all connecting variants for the tie members occurring in practice, four differently formed connecting elements are provided. According to variant 1, two connecting lugs are provided, uniaxially opposite each other. According to variant 2, four connecting lugs are provided, biaxially crosswise opposite each other. According to variant 3, four connecting lugs are provided, uniaxially in pairs opposite each other. According to variant 4, six connecting lugs are provided, biaxially crosswise opposite each other. Thus, all connecting combinations for tie members, that are actually applicable in practice, can be covered with only four different connecting elements.

According to a preferred configuration, each connecting element has a hollow, pot-shaped body, on the bottom of which a through opening is provided for the passage of the connecting rod. Such a connecting element is particularly easy to manufacture and to manipulate.

If, according to an advantageous further development, the pot-shaped body has a peripheral wall, which is provided with a thread at its inside, the body is individually usable and is adaptable to different situations.

Depending on the requirements, an adapter for attaching the additional compression bar, the attaching element for attaching the compression bar system at the façade, or the cover cap can be screwed into the thread. Thus, the same body can be used for very different purposes.

In order to guarantee a secure support of the compression bar at the connecting element and a good introduction of forces into the connecting element, in its bottom area, the pot-shaped body has a stepped shoulder on which the compression bar can be fitted. Thus, the compression bar bears in a secure position on the connecting element, simultaneously guaranteeing a good transmission of forces.

An annular groove for receiving an O-ring is provided in the area of the shoulder, on the one hand, in order to achieve a play-free support of the compression bar at the connecting element and, on the other hand, in order to prevent moisture from penetrating into the compression bar.

BRIEF DESCRIPTION OF THE DRAWINGS

Further details, features and advantages of the invention will become apparent from the following description of preferred exemplary embodiments, wherein.

DETAILED DESCRIPTION OF THE PREFERRED EMBODIMENTS

Figure 2:
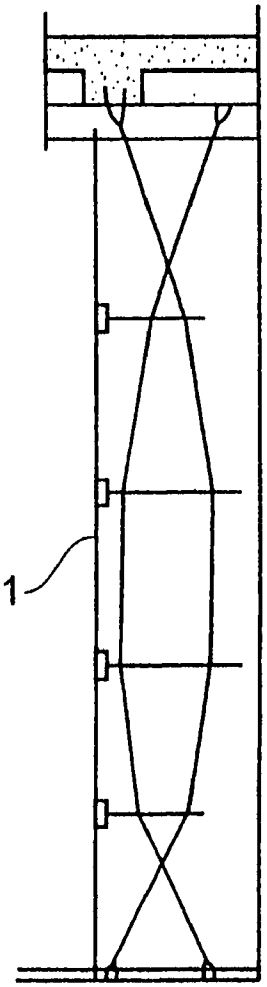
FIG. 2: shows a section through a braced façade structure along the line A-A in FIG. 1, FIGS. 3*a* to 3*d*: show different variants of compression bar systems.
Figure 1:
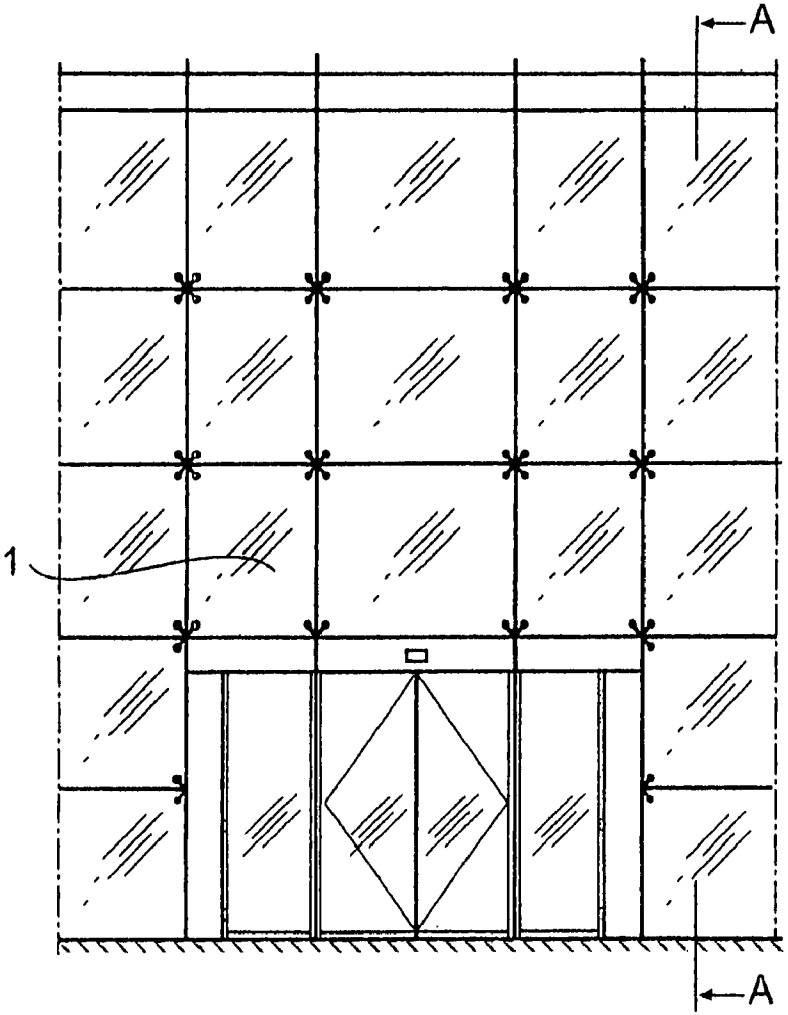
FIG. 1: shows a diagrammatical layout of a braced facçade structure.

In FIGS. 1 and 2, a conventionally braced façade structure 1 is shown. This façade structure 1 may consist of glass plates, for example, which are suspended in front of the actual building. In order to reliably transfer the loads, which act on the façade structure 1 and are composed of own weight, wind, etc., an assembly consisting of compression bar systems and tie members transferring the forces into the building, is provided behind the actual glass façade.

Figure 3A:
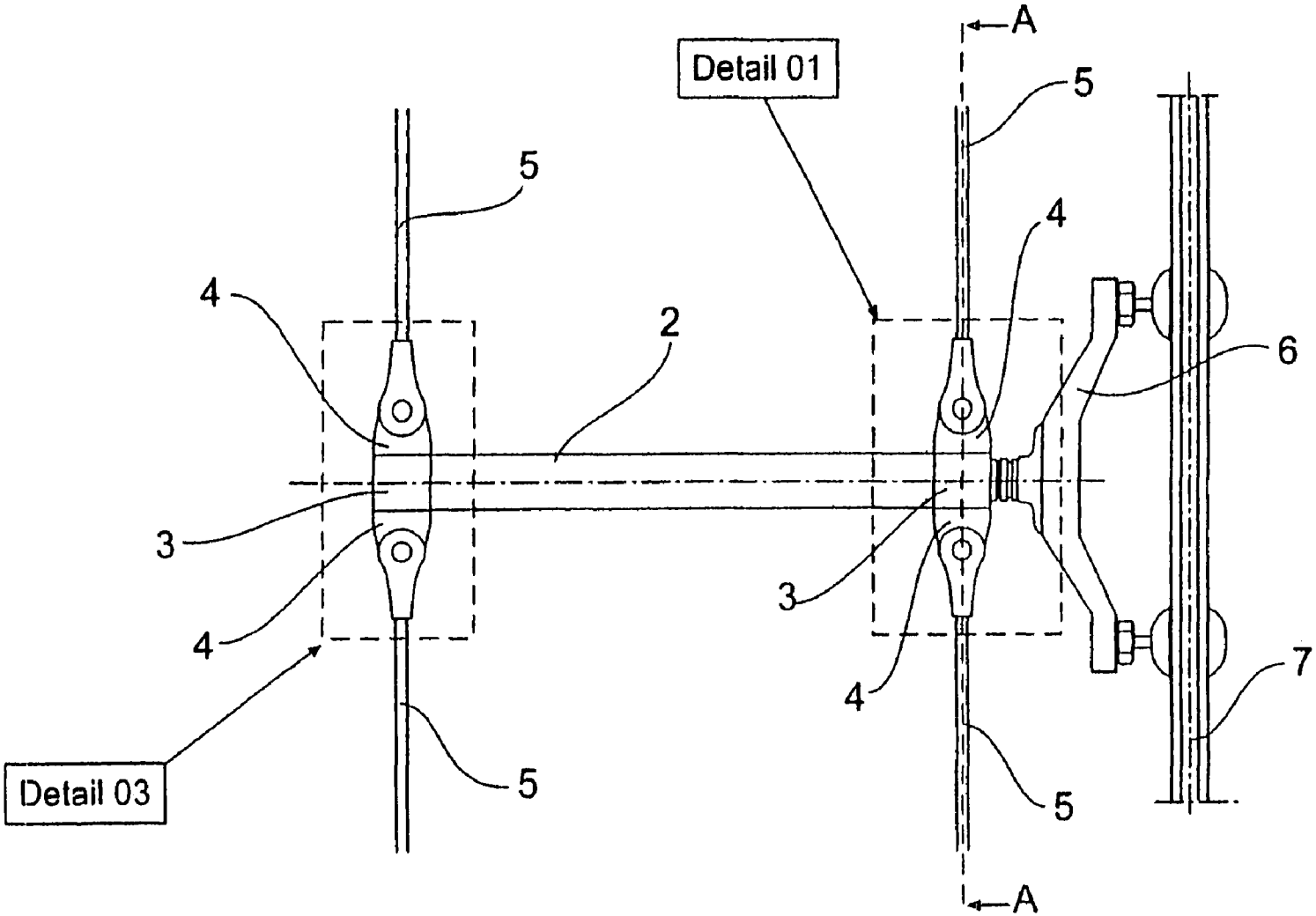

In FIGS. 3*a* to 3*d*, different variants of compression bar systems are illustrated, which occur in practical applications. FIG. 3*a* shows a compression bar system with a compression bar 2 and one connecting element 3 respectively fitted onto the two ends of the compression bar 2. All connecting elements 3 are formed as a pre-fabricated individual part and thus allow for a modular assembly of connecting elements 3 and compression bars 2 to form the respective structure required on-site. Connecting lugs 4, serving to connect tie members 5, are provided at the connecting elements 3.

In FIGS. 3*a* to 3*d*, four different connecting elements 3 are depicted, which guarantee a reliable connection of the tie members 5 to the connecting elements 3 and to the compression bars 2 for all load conditions occurring in practice.

The connecting element 3 in FIG. 3*a* is provided with one attaching element 6, which serves for the attachment of the façade structure at the building 7. The two connecting elements 3 are respectively provided with two connecting lugs 4, which are uniaxially opposite each other and thus allow for the connection of respectively two tie members 5, as can be seen in FIG. 4*a* as well, showing a section through a connecting element 3 according to FIG. 3*a*.

Figure 3D:
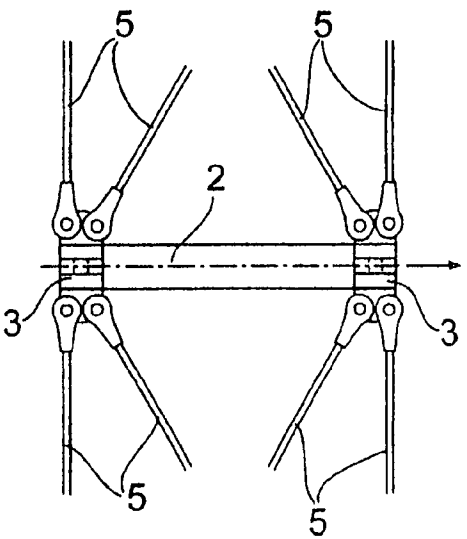
Figure 3C:
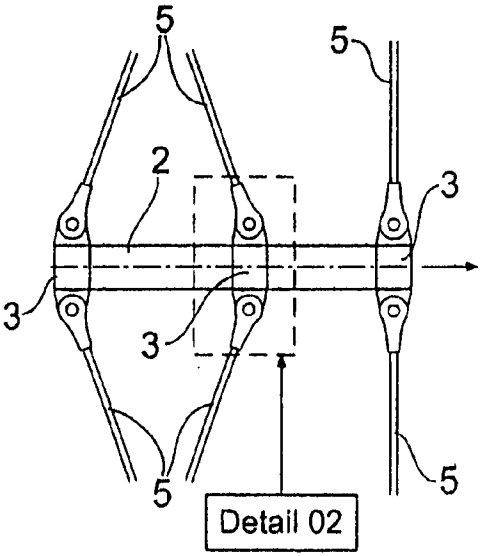
Figure 3B:
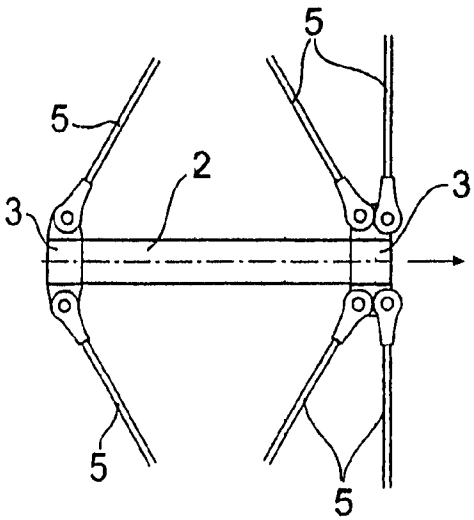

FIG. 3*b* shows a compression bar 2, at each end thereof a connecting element 3 being attached. In this case, two tie members 5 can be connected to the left connecting element 3, as already shown in FIG. 3*a*, whereas four tie members 5 are connected to the right connecting element 3. For this purpose, in total four connecting lugs 4 are provided which are uniaxially opposite each other and therefore allow for connecting four tie members 5, which are all located in the same plane.

FIG. 3*c* shows another embodiment variant of the connecting elements 3, in which not only a connecting element 3 is disposed at both ends of the compression bar 2, but in addition also in the central area of the compression bar 2, in order to be able connect tie members 5 in the central plane as well.

FIG. 3*d* shows an embodiment in which one connecting element 3 is provided at both ends of the compression bar 2 respectively. Each of the connecting elements 3 is provided with six connecting lugs 4 which are biaxially crosswise opposite each other.

Figure 4B:
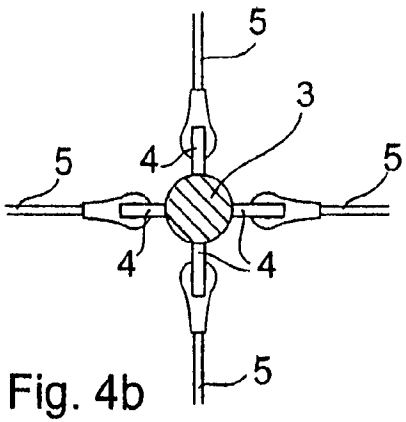
FIGS. 4*a* to 4*b*: show sections through two embodiment variants of the connecting elements.
Figure 4A:
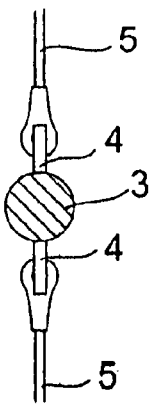

In FIG. 4*b* one connecting element 3 is illustrated, in which four connecting lugs 4 are provided, which are biaxially crosswise opposite each other and thus allow the connection of a total of four tie members 5.

Figure 5A:
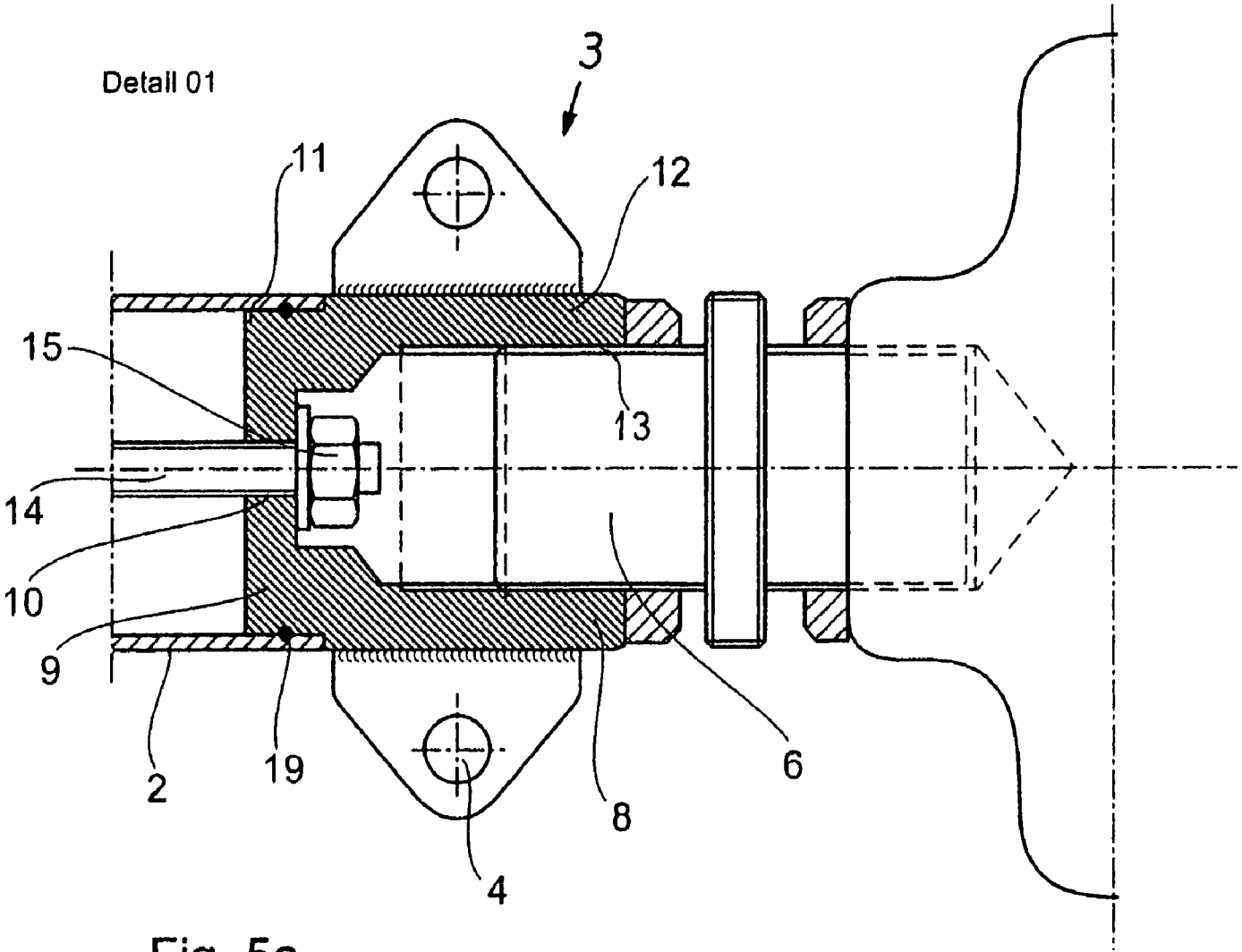
FIGS. 5*a* to 5*c*: show detailed views of the same connecting element for different application purposes.
Figure 5B:
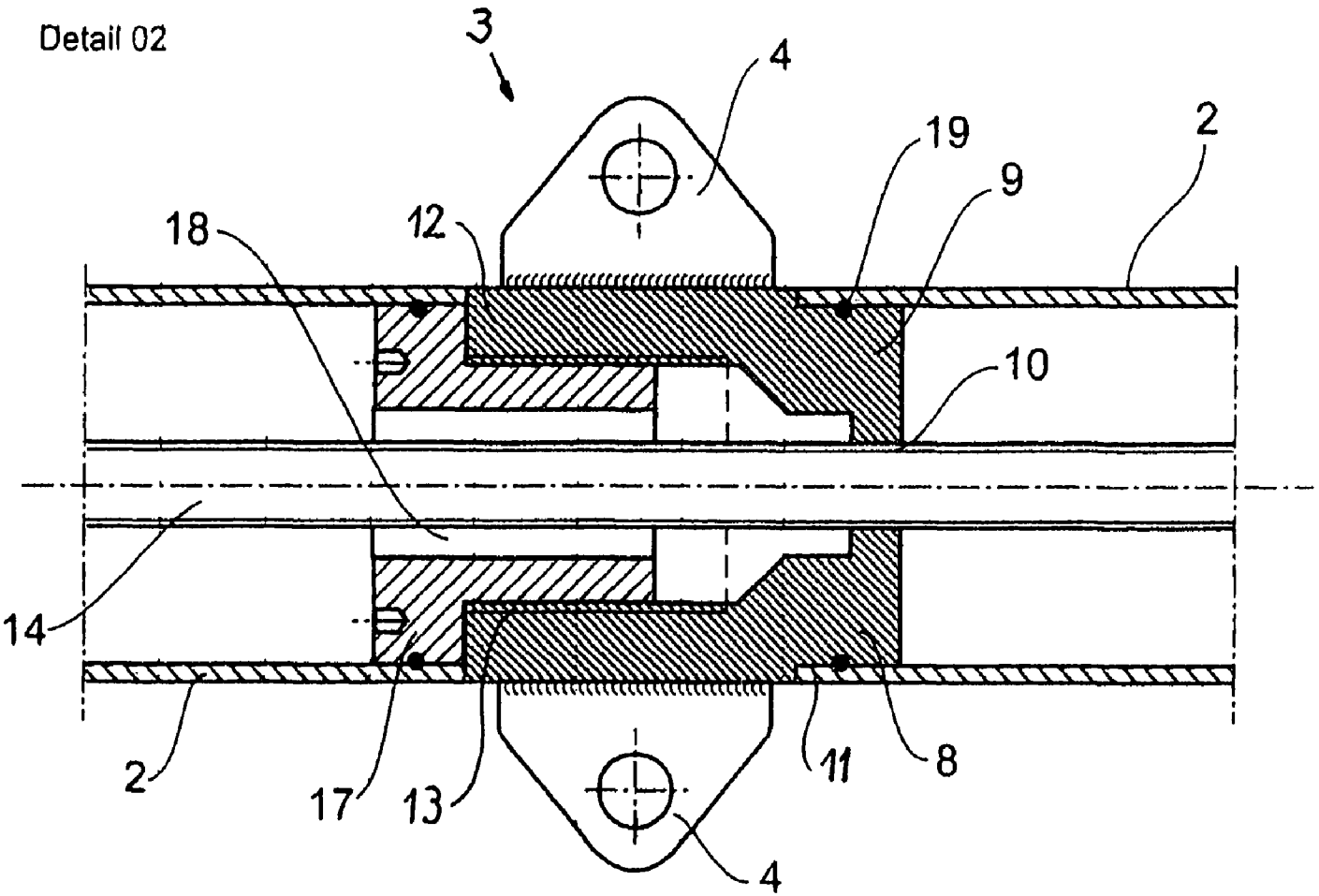
Figure 5C:
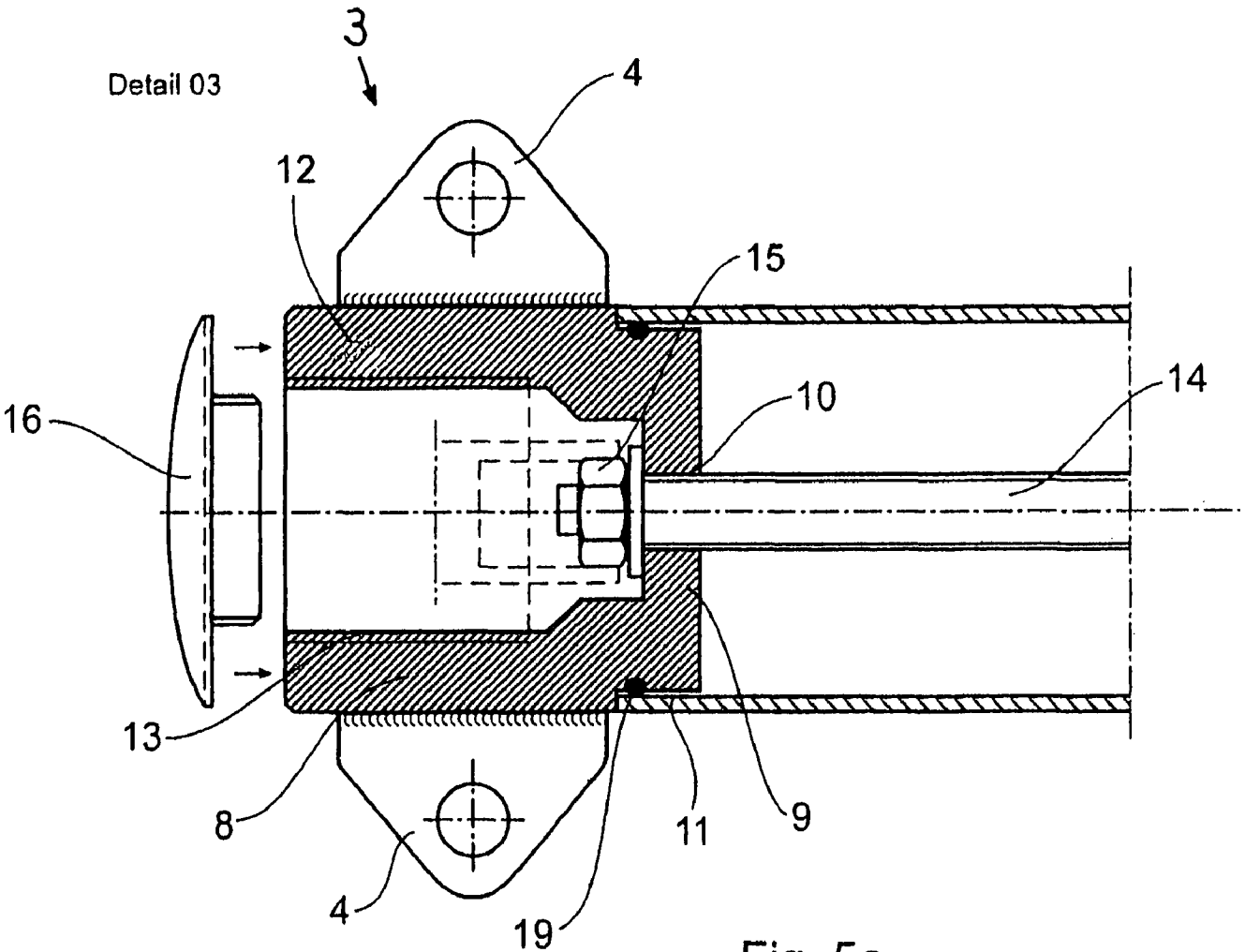

FIGS. 5*a* to 5*c* show the connecting element 3, illustrated in the other Figures, in an enlarged detailed view for various application purposes. FIG. 5*a* shows the connecting element 3 according to FIG. 3*a*, FIG. 5*b* the connecting element 3 according to FIG. 3*c*, and FIG. 5*c* the connecting element 3 according to FIG. 3*b*, respectively in an enlarged view.

As will result from the comparison of FIGS. 5*a* to 5*c*, in all illustrated cases, the connecting element 3 has a pot-shaped body 8 open to one side, with a bottom 9, in which a central through opening 10 is disposed. A stepped shoulder 11 is provided in the area of the bottom 9, to which the compression bar 2 can be fitted such that the compression bar 2 is bearing with its frontal edge on the body 8. On account of the shoulder 11, partially extending into the compression bar 2, in addition a reliable support of the compression bar 2 at the shoulder 11 of the connecting element 3 is guaranteed. Furthermore, the pot-shaped body 8 has a peripheral wall 12, which, on its inside, is provided with a thread 13. On the outside, the peripheral wall 12 is provided with the connecting lugs 4, as already mentioned, for attaching the tie members 5.

A connecting rod 14, which passes through the compression bar 2 and the through opening 10 in the connecting element 3, serves for a rigid, yet releasable connection of compression bar 2 and connecting elements 3. For this purpose, respectively one connecting element 3 is fitted to both ends of the compression bar 2. The connecting rod 14 is then passed through the two connecting elements 3 and the compression bar 2 and screwed-on by means of nuts 15 located on the inside, as shown in FIG. 5*a* for the right connecting element 3 and in FIG. 5*c* for the left connecting element 3.

In addition FIGS. 5*a* to 5*c* reveal that the same connecting element 3 can be used on both, the right hand side and the left hand side or in the central area of the compression bar 2.

FIG. 5*a* shows the use of the connecting element 3 at the right end of the compression bar 2. In order to attach the compression bar 2 at the building 7, the attaching element 6, already mentioned in conjunction with FIG. 3*a*, is screwed into the thread 13 of the peripheral wall 12, by means of which element the compression bar 2 can be attached at the building 7.

FIG. 5*c* shows the use of the connecting element 3 at the left end of the compression bar 2. In order to cover this end of the connecting rod 14 and the nut 15 screwed onto the connecting rod 14, a cover cap 16 is screwed into the thread 13 of the peripheral wall 12.

FIG. 5*b* shows a variant, in which the compression bar 2, also in its central area, is provided with a connecting element 3 for connecting to a central plane of tie members 5. For this purpose, an adapter 17 is screwed into the thread 13 of the peripheral wall 12 for fitting an additional compression bar 3. This adapter 17 has an exterior circumference, which corresponds to the exterior circumference of the shoulder 11, such that the compression bar 2 can be attached to the adapter 17 and, with its frontal side, bears on the body 8. The adapter 17 is provided with a central through bore 18, through which the connecting rod 14 passes, thus connecting the compression bar 2 and the connecting elements 3.

In the area of the bottom 9 of the pot-shaped body 8, the shoulder 11 is provided with an annular groove 19, into which an O-ring is inserted, which allows for a tight connection between the shoulder 11 and the fitted compression bar 2. An annular groove for the O-ring is machined into the adapter 17 as well.

Each connecting element 3 can be used on the right hand side, the left hand side, or in the central area of the compression bar 2 with different tie connecting variants as a standardized, pre-fabricated structural part. The compression bars 2 can be economically pre-fabricated for each individually required length or they may be cut to length in simple operational steps on the construction site. All individual components can be individually inserted into each other and reliably braced with the internally located connecting rod 14 via a simple screw-connection within the connecting elements 3. Thus any compression bar systems in any dimensions can be assembled easily, quickly and economically from a few manageable individual parts directly at the place of installation.

The above description of the exemplary embodiment according to the present invention serves for illustrative purposes only and is not intended to limit the invention. Various changes and modifications are possible within the range of the invention without leaving the scope of the invention or the equivalents thereof.

The invention claimed is:

1. A compression bar system for a braced façade structure, comprising:

a compression bar;

connecting elements connected to the compression bar and including tie connectors connectable to tie members of the braced façade structure; and a connecting rod, the compression bar and each connecting element being connected to each other by the connecting rod passing through the compression bar and said each connecting element, wherein each connecting element is formed as a single integral pre-fabricated unit and is connectable to the compression bar as the single integral pre-fabricated unit.

2. The compression bar system of claim 1, wherein each connecting element is releasably connected to the compression bar.

3. The compression bar system of claim 2, wherein the connecting elements comprise a first connecting element releasably connected to a first end of the compression bar, and a second connecting element releasably connected to a second end of the compression bar.

4. The compression bar system of claim 3, further comprising an attaching element connected to the first connecting element for attachment to a building.

5. The compression bar system of claim 3, further comprising a cover cap covering an open end of the second connecting element.

6. The compression bar system of claim 3, wherein the connecting elements comprise a third connecting element connected to a portion of the compression bar between the first end and the second end.

7. The compression bar system of claim 1, wherein the tie connectors comprise connecting lugs for connection to the tie members.

8. The compression bar system of claim 7, wherein the connecting lugs comprise two connecting lugs which are uniaxially opposite each other.

9. The compression bar system of claim 7, wherein the connecting lugs comprise four connecting lugs which are biaxially crosswise opposite each other.

10. The compression bar system of claim 7, wherein the connecting lugs comprise two pairs of connecting lugs, the connecting lugs of each pair being uniaxially opposite each other.

11. The compression bar system of claim 7, wherein the connecting lugs comprise six connecting lugs which are biaxially crosswise opposite each other.

12. The compression bar system of claim 1, wherein each connecting element has a hollow, pot-shaped body, the pot-shaped body having a bottom and a through opening at the bottom for receiving the connecting rod.

13. The compression bar system of claim 12, wherein the pot-shaped body comprises a peripheral wall having a threaded interior surface.

14. The compression bar system of claim 13, further comprising an element threadably receivable in the threaded interior surface, the element comprising one of an adapter for receiving an additional compression bar, an attachment element for attachment to a building, or a cover cap for covering an open end of the pot-shaped body.

15. The compression bar system of claim 12, wherein the pot-shaped body has a stepped shoulder at the bottom so that the compression bar is fittable on the stepped shoulder.

16. The compression bar system of claim 15, further comprising an O-ring received in an annular groove define in the stepped shoulder.

* * * * *